US005317874A

United States Patent [19]

Penswick et al.

[11] Patent Number: 5,317,874

[45] Date of Patent: Jun. 7, 1994

[54] SEAL ARRANGEMENT FOR AN INTEGRAL STIRLING CRYOCOOLER

[75] Inventors: Laurence B. Penswick; Carl D. Beckett, both of Richland, Wash.

[73] Assignee: Carrier Corporation, Syracuse, N.Y.

[21] Appl. No.: 550,588

[22] Filed: Jul. 10, 1990

[51] Int. Cl.[5] ..... F02G 1/04; F25B 9/00

[52] U.S. Cl. ..... 60/517; 62/6

[58] Field of Search ..... 62/6; 60/517

[56] References Cited

U.S. PATENT DOCUMENTS 4,532,766 8/1985 White et al. ..... 60/517

4,620,418 11/1986 Fujiwara et al. ..... 60/517

*Primary Examiner*—Charles T. Jordan

[57] ABSTRACT

The seal bellows of a Stirling cycle device is connected between the bottom of a reciprocating piston and a cylinder wall to form a buffer space between the cycle working space and the lubricated crankcase. The piston and cylinder wall form a noncontact clearance seal between the buffer space and the working space in which an expander piston has a vented clearance seal to reduce the thermal loss due to cold gas leaking along the clearance seal.

3 Claims, 6 Drawing Sheets

SEAL ARRANGEMENT FOR AN INTEGRAL STIRLING CRYOCOOLER

BACKGROUND OF THE INVENTION

As is well known, Stirling cycle cryogenic refrigerators, or cryocoolers, use a motor driven compressor to impart a cyclical volume variation in a working space filled with pressurized refrigeration gas. The pressurized refrigeration gas is fed from the compressor working volume through a heat exchanger assembly to an expansion working volume to which is attached the cold head. The heat exchanger assembly is made up of a heat exchanger located in the cold head, a regenerator, and another heat exchanger located adjacent to the compressor. The regenerator has openings in either end to allow the refrigeration gas to enter and exit.

The compressor and expander reciprocate in a fixed relationship creating the volume variations in the working space necessary to impart the Stirling cycle, and the refrigeration gas is forced to flow through the heat exchanger assembly in alternating directions. As the components reciprocate, the heat exchanger which directly receives the refrigeration gas from the compressor becomes much warmer than the ambient. In the other heat exchanger, attached to the expansion space, the gas is much colder than ambient. The device to be cooled is mounted adjacent the expansion space.

Because the cryocooler is sealed, the volume of the expansion and compressor spaces varies as the expander and compressor pistons reciprocate. The efficiency of a Stirling cryocooler is optimized by properly timing the movement of the expander and compressor pistons. Specifically, the component movements should be such that the variations in the volume of the expansion space lead the variations in the volume f the compression space by approximately 90°. This insures that the compressor space pressure and temperature are at a peak before the refrigeration gas enters the regenerator from the warm end heat exchanger. To be cost effective Stirling cryocoolers must have long, maintenance free operating lives.

The two most common configurations of Stirling cryocoolers are referred to as "split" and "integral". The split Stirling type has a compressor which is mechanically isolated from the expander. Cyclically varying pressurized gas is fed between the compressor and expander through a gas transfer line. In most split Stirling cryocoolers proper timing of expander movement is achieved by using precision friction seals.

In an integral Stirling cryocooler, the compressor, heat exchangers, and expander are assembled in a common housing. The typical arrangement uses an electric motor to drive the moving parts. A crankshaft, disposed in a crankcase, is used to properly time compressor and expander movement, much as an internal combustion engine uses a crankshaft to provide proper timing of the movement of its pistons. As such, the typical integral cryocooler requires several bearings to support the crankshaft. If connecting rods are used to couple the compressor and expander to the crankshaft, additional bearings are required. A problem with this arrangement is that these bearings require lubricant. Also, lubricants are subject to freezing at cryogenic temperatures causing flow blockage within the regenerator reducing performance of the cryocooler. One way to eliminate the problem caused by lubrication is to seal the oil containing refrigerant gas in the crankcase from the oil-free refrigerant gas in the compressor and expander. Many different sealing arrangement have been used. Some Stirling systems use contact seals of the wearing type. However, these arrangement produce wear particles, which result in limited operating life. Other systems use elastomeric roll sock seals, which are complex, expensive and do not produce consistent life time results.

Further, other systems use a plurality of complicated bellows seal located within the Stirling Cycle work space, coupled with auxiliary pressure compensator seals which are located outboard of the bellows seal whereby the bellows seal is connected through a pump piston and a power piston simultaneously, as shown in U.S. Pat. No. 4,532,766. However, pressure pulsations inherent in the Stirling Cycle will cause unacceptable pressure differences across a single bellows seal located within the Stirling Cycle work space leading to high bellows material stresses and short operating life.

SUMMARY OF THE INVENTION

The bellows seal of the conventional pump piston, which is attached to the top of the piston, in addition to a plurality of power piston bellows and a plurality of compensation bellows is eliminated, and a simple, single bellows seal down stream of a non-contact, small gap clearance seal is used which forms a buffer space which essentially eliminates the pressure pulsations in a Stirling cycle due to the filtering characteristics of the clearance seal between the piston and the cylinder wall. Further, a vented clearance seal, which forms a thermal seal and pumping seal, significantly reduces the thermal seal DELTA-P and any gas leakage past the pumping seal does not transfer cold gas.

It is an object of the present invention to completely separate the oil laden gas from the Stirling cycle gas with the use of a hermetic bellows seal.

It is another object of the present invention to operate the hermetic bellows in a long life mode by using a clearance seal and buffer volume.

It is a further object of the present invention to employ a bellows seal, a clearance seal, and a buffer volume or space to minimize power losses and/or maximize efficiency.

It is still another object of the present invention to employ a bellows seal, a vented clearance seal, and a buffer space to minimize thermal losses across the piston.

Basically, the pressure of the buffer space, due to the clearance seal, is the same as the mean working pressure of the Stirling cycle work or expansion space and the mean pressure in the oil lubricated crankcase, thus, the metal bellows seal does not experience any pressure difference across it. Further, venting the clearance seal (which is a combination thermal seal and pumping seal) to the compression space reduces the thermal seal DELTA-P from the difference in pressure between the expansion space and the buffer space to the difference in pressure between the expansion space and the compression space, while the pumping seal only affects the compression space and buffer space pressures. The operating life and performance are also improved by elimination of contact seals and removing unused space previously occupied by a plurality of bellows and pressure compensators.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
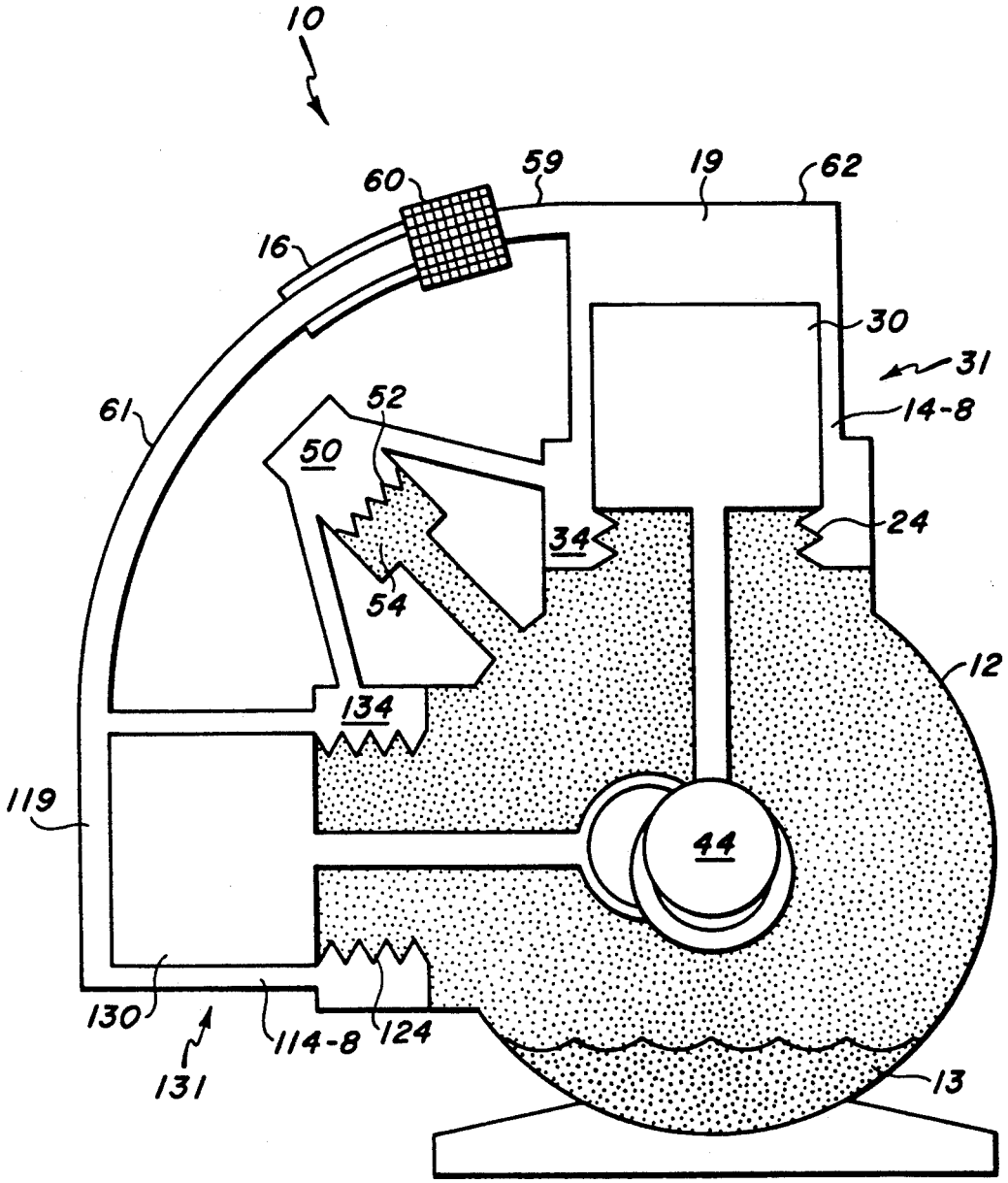
FIG. 1 is a schematic representation of a Stirling cycle device employing the present invention.

In FIGS. 1-5 the numeral 10 generally designates a Stirling cycle cryocooler having a crankcase 12. Crankcase 12 has an oil sump 13 and is filled with oil laden helium (refrigerant gas). A motor (not illustrated) is located within crankcase 12 and by way of crankshaft 44 drives piston 30 of expander 31 and piston 130 of compressor 131. Referring specifically to FIG. 1, it will be noted that piston 30 is sealed with respect to crankcase 12 by single bellows seal 24 and similarly, piston 130 is sealed with respect to crankcase 130 by single bellows seal 124. It will be noted that crankcase 12 and bellows 124 define a chamber 34 that is fluidly isolated from the interior of crankcase 12. Similarly, crankcase 12 and bellows 124 define a chamber 134 that is fluidly isolated from the interior of crankcase 12. Chambers 34 and 134 are , however, connected through compensator of buffer chamber 50. Buffer 50 is separated from chamber 54 by diaphragm 52 and chamber 54 is in fluid communication with the interior of crankcase 12. Expander 31 and compressor 131 are connected via cold end heat exchanger 59, regenerator 60, warm end heat exchanger 16, and line 61.

To attain the long operating life required in cryocoolers it is necessary that the metal bellows be operated in a manner that does not cause excessive pressure differences to exist across the bellows (for example, between spaces 34 and 54 in FIG. 1). Since the normal Stirling cycle pressure variation within the compression or expansion spaces are well above the limits that the bellows can sustain, the bellows of the present invention have been located on the crankcase side of the compressor piston 30 and expander piston 130 and are fixed between the piston and cylinder wall, e.g. by welding. The bellows are generally fixed to the underside of the pistons 30, 130 at desired radial distances along the underside. The small clearance seal along the piston separating the expansion and compression spaces from their respective buffer spaces (34 and 134 in FIG. 1) essentially eliminates the Stirling cycle pressure variations. This arrangement of bellows seal attached between the crankcase and the crankcase side of the piston, and a clearance seal maintains this buffer space 134 at essentially the mean cryocooler operating pressure with only a minor pressure fluctuation being present. The crankcase charge pressure is also close to mean cryocooler operation pressure reducing the effective bellows pressure difference to values which allow long operation life. Location of the bellows 24 and 124 in buffer space 34 and 134 on the crankcase side of the pistons 30 and 130 also isolates internal bellows volume surface areas from Stirling reference gas space, thus increasing performance of the Stirling cycle. The diaphragm 52 located within the buffer chamber 52 will maintain the low pressure differences in situations where the crankcase and Stirling cycle mean pressures differ slightly possibly due to unexpected temperatures due to manufacturing variations.

The gas in regenerator 60, heat exchangers 59 and 16, and in chambers 34, 50 and 134 as well as in expander 31 and compressor 130 is pure helium. In operation of the FIG. 1 system, compressor 131 is driven approximately 90° behind expander 131.

During the compression phase of the Stirling cycle, the expander piston 30 is phased such that the volume in the expansion space 19 is at a minimum indicating that the majority of the refrigerant gas is located in the heat exchangers and the compression space 119. In this compression phase the refrigerant gas is kept at nearly constant temperatures by rejecting thermal energy out of the warm end heat exchanger 16 to a sink. The refrigerant gas is then transferred to the expansion space 19 by a coordinated motion of both pistons 30 and 130. Then at the end of this phase the compression space 119 is at a minimum. The expander piston 30 then is moved so as to further increase the volume of the expansion space 19, cooling the refrigerant gas and allowing energy to be absorbed by the cold end heat exchanger 59 which can be an integral part of the cold head 62. The cooling effect maintains the device mounted adjacent the cold head at the desired temperatures. In the same process, the coordinated motion of the compressor 130 and expander 30 pistons return the gas to the compression space 119 allowing the cycle to repeat itself.

Figure 2:
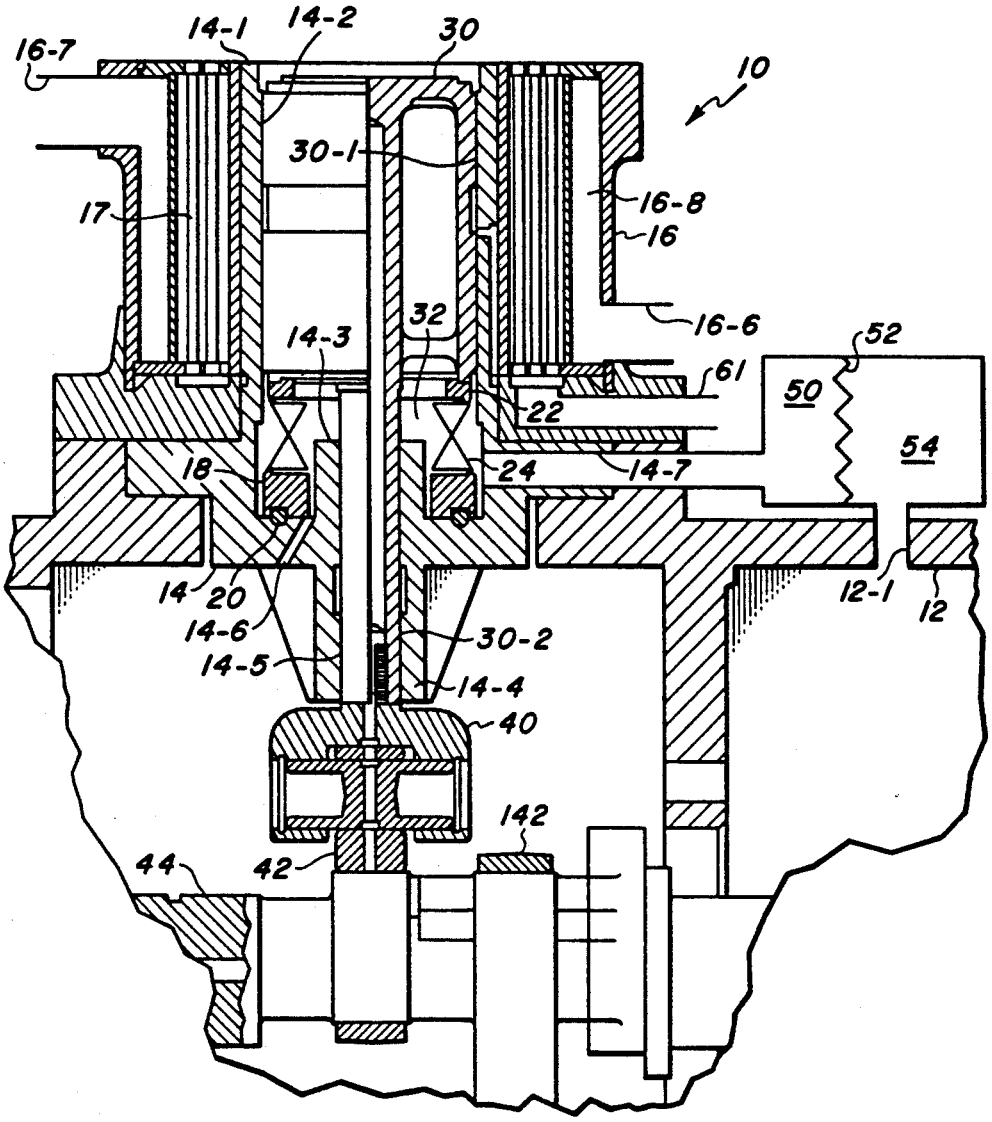
FIG. 2 is a partially sectioned view of a portion of the expander assembly of a Stirling cycle device with the piston at top dead center.
Figure 3:
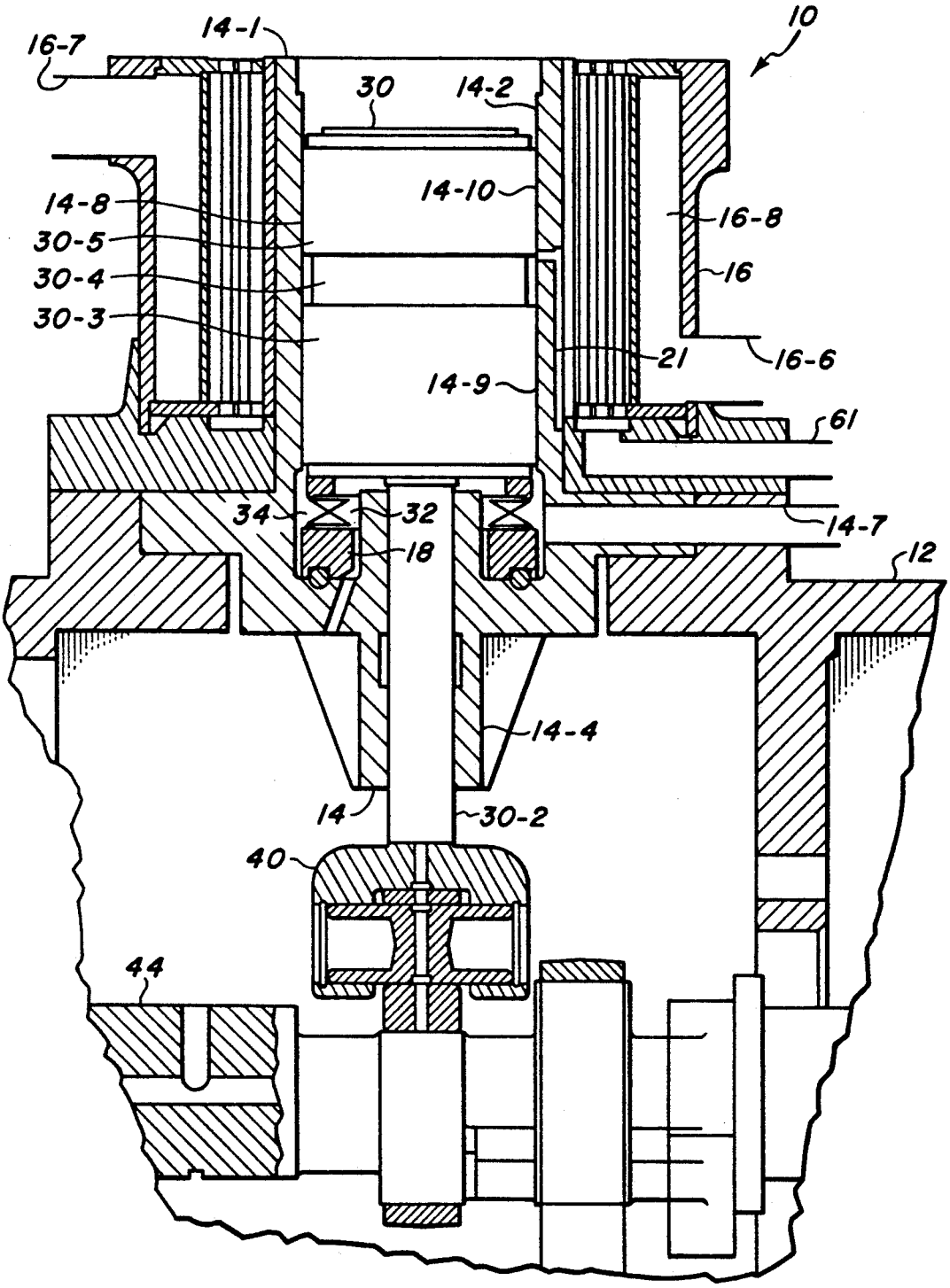
FIG. 3 is similar to FIG. 2 except that the piston is at bottom dead center.
Figure 4:
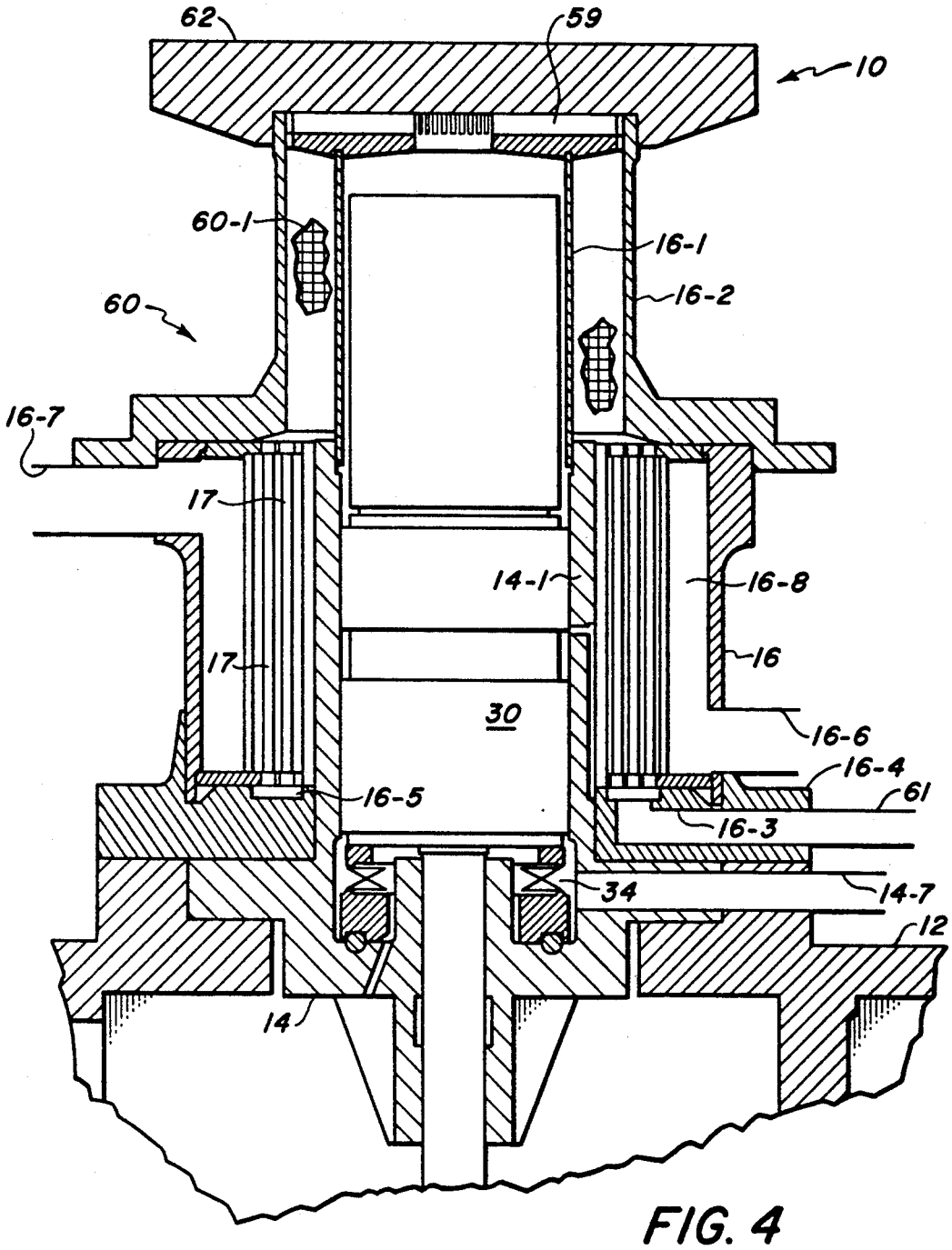
FIG. 4 is similar to FIG. 3 except that it shows additional portions of the cold head and regenerator.

Referring now specifically to FIGS. 2-4 crosshead 14 is sealed and secured to crankcase 12 by bolt or other suitable structure (not illustrated) and seals. Cylindrical portion 14-1 is received within heat exchanger 16 of the expander assembly which defines bore 14-2. Crosshead 14 further includes coaxial tubular portions 14-3 and 14-4 which define bore 14-5. Annular, lower terminal 18 is suitably secured to crosshead 14 by bolts or the like and surrounds tubular portion 14-3. 0-ring or other suitable seal 20 provides a fluid seal between lower terminal 18 and crosshead 14. Annular bellows seal 24 is secured between lower terminal 18 and piston 30 in a fluid tight manner, such as by welding.

Figure 5:
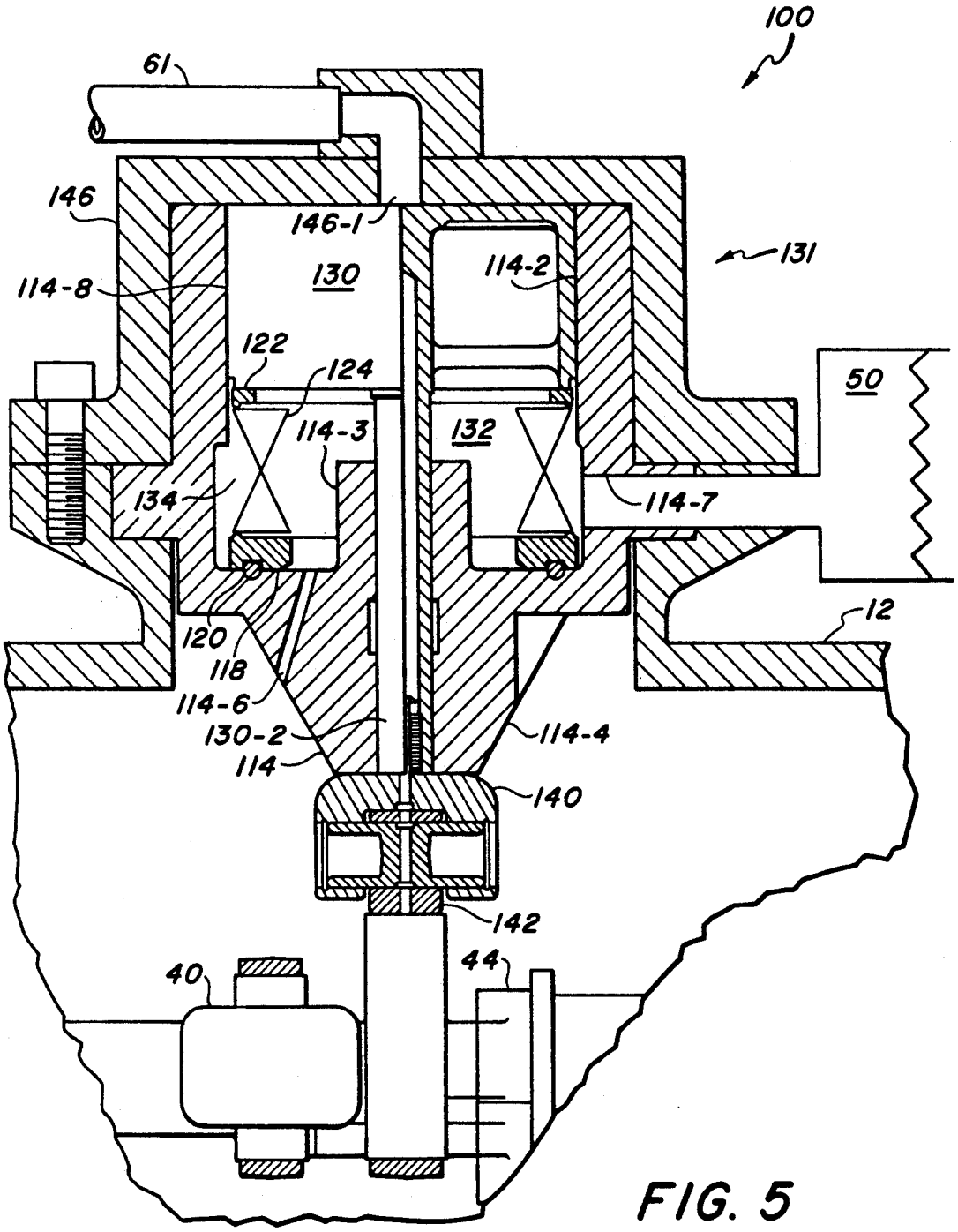
FIG. 5 is a partially sectional view of the compressor in the top dead center position.

During operation, both the expansion 19 an compression 119 spaces experience pressure variations due to the Stirling cycle which are periodically above and below the mean cryocooler pressure. This instantaneous pressure difference between the buffer spaces 34 and 134 and their respective work spaces 19 and 119 is the driving potential for leakage past the clearance seals 14-8 and 114-8 in the expander and compressor respectively. This leakage essentially eliminates the pressure pulsations in the Stirling Cycle due to the filtering characteristics of the clearance seals. This leakage may, however, represent a power loss that can be made up for in the form of added power into the drive motor. However, in the case of the expander piston 30, there is an additional loss which directly reduces cooling capacity of the cryocooler. This loss is caused by cold gas being drawn out of the expansion space 19 during part of the cycle and warm gas forced into the expansion space during the remainder of the cycle causing a net loss in cryocooler capacity. This loss or thermal leakage is a function of the difference between the expansion space pressure and the FF space pressure. This loss can by reduced by minimizing the clearance seal gap 14-8. This loss can further be reduced by venting the clearance seal gap 14-8. The vented seal embodiment minimizes losses while permitting greater clearance seal gaps 14-8 an 114-8, since very close tolerance gaps are more difficult to manufacture. FIGS. 1 and 5 show an embodiment with a single section clearance seal. In FIGS. 2–4, the expander piston 30 is broken down into three sections, a lower portion 30-3, a recessed portion 30-4 and an upper portion 30-5, which form expander lower piston seal 14-9 and an upper piston seal 14-10. The lower expander or pumping seal functions the same as the compressor piston seal 114-8 and has a pressure across it equal to the difference between the compression space pressure and the buffer space pressure. The recessed portion 30-4 of piston 30 is vented to annular chamber 16-5 in the warm end heat exchanger 16 through passage 21. The pressure of the gas in the small passage 21 and annular chamber 16-5 is the same as in the compression space 119 so that the driving potential for the leakage to and from the cold expansion space 19, or the thermal seal, is only the pressure difference across the heat exchanger 59 or the difference between the expansion space pressure and the compression space pressure. This generally is an order of magnitude lower than the driving potential between the expansion space 19 and the buffer space 50. This allows the upper seal 14-10 to be made shorter if close tolerances are used, or employ a larger radial gap if the length of the upper seal remains the same. Through optimization of the lengths of the seals, it is possible to provide an expander seal which has a combination of thermal losses and gaps large enough to allow easy manufacture, reduces expander piston and seal height, also reducing weight, and increases allowable gap dimension allowing for easier manufacturing.

Piston 30 includes a piston head having an annular cylindrical portion 30-1 received in bore 14-2 in a non-contacting relationship and integral guide rod 30-2 which is reciprocally received in bore 14-5. Guide rod 30-2 is secured to clevis 40 and thereby strap 42 an crankshaft 44 in any suitable conventional manner.

Tubular portion 14-3, lower terminal 18, the interior surface of bellows 24, upper terminal 22 and the interior of cylindrical portion 30-1 define a chamber 32 which is in fluid communication with the interior of crankcase 12 by way of bore 14-6 in crosshead 14. A second chamber 34 is defined by the exterior surface of bellows 24, lower terminal 18, upper terminal 22 and bore 14-2. Chamber 34 has a restricted communication across piston 30 by way of the clearance seal gap 14-8 between cylindrical portion 30-1 an bore 14-2 as described above and is in fluid communication by way of 14-7 with buffer chamber 50. Buffer chamber 50 is separated from buffer chamber 54 by diaphragm 52. Buffer chamber 54 is in communication with the interior of crankcase 12 by way of 12-1.

The regenerator 60, as best shown in FIG. 4. is located in the annular region above warm end heat exchanger or cooler 16 within cylinders 16-1 located in upper casing or shell 16-2 and cold head 62. Helium gas passing from compressor 131 via line 61 enters bore 16-3 in lower casing 16-4 and then passes into annular chamber 16-5. The helium gas passes from annular chamber 16-5 into warm end heat exchanger tube 17 in warm end heat exchanger 16, passes into upper casing 16-2 containing the regenerator 60 and through the combined cold end heat exchanger 59 and cold head 62 which is cooled thereby.

Compressor 131, as best shown in FIG. 5, is structurally similar to expander 31 and corresponding structure has been numbered 100 higher. Cover 146 is suitably secured to crankcase 12 and coacts with bore 130-1 of crosshead 114 to define the gas volume being compressed by piston 130. Cover 146 has a bore 146-1 connected to line 61 and a bore 146-2 connecting bore 114-7 to chamber 50. The coacting of piston 130 and bellows 134 and clearance seal 114-8 is the same as that of piston 30, bellows 24 and clearance seal 14-9, 14-10.

In operation, crankshaft 44 is rotated by a motor (not illustrated) which, in turn, drives strap 42 of the expander 31 and strap 142 of the compressor 131. Straps 42 and 142 are approximately 90° out of phase as the the piston 130 of the compressor 131 is driven 90° behind piston 30. In comparing the top dead center position of FIG. 2 with the bottom dead center of FIG. 3 and 4, it will be noted that chambers 32 and 34 each have their greatest volumes in their FIG. 2 position and then smallest volumes in their FIG. 3 and 4 positions. As a result, chambers 32 and 34 are, effectively, pumping volumes during the operation of the cryocooler 10. Starting with the FIG. 2 position of the device, chambers 32 and 34 are at a maximum, as noted. As piston 30 moves from the FIG. 2 position towards the FIG. 3 and 4 position, oil laden refrigerant gas in chamber 32 will return to crankcase 12 via bore 14-6 in crosshead 14. Additionally refrigerant gas from chamber 34 will be forced into buffer chamber 50 via bore 14-7 and will act on diaphragm 52 in opposition to the refrigerant in chamber which is at crankcase pressure. Diaphragm 52 will be positioned responsive to the pressure differential between chambers 50 and 54. Because of the clearance seal 14-8 formed by the small clearance between cylindrical portion 30-1 and bore 14-2 the pressure differential will normally be less than 10 psi. The foregoing description of expander 31 also applies to the corresponding structure of compressor 131 which is numbered 100 higher, as noted above.

Figure 6:
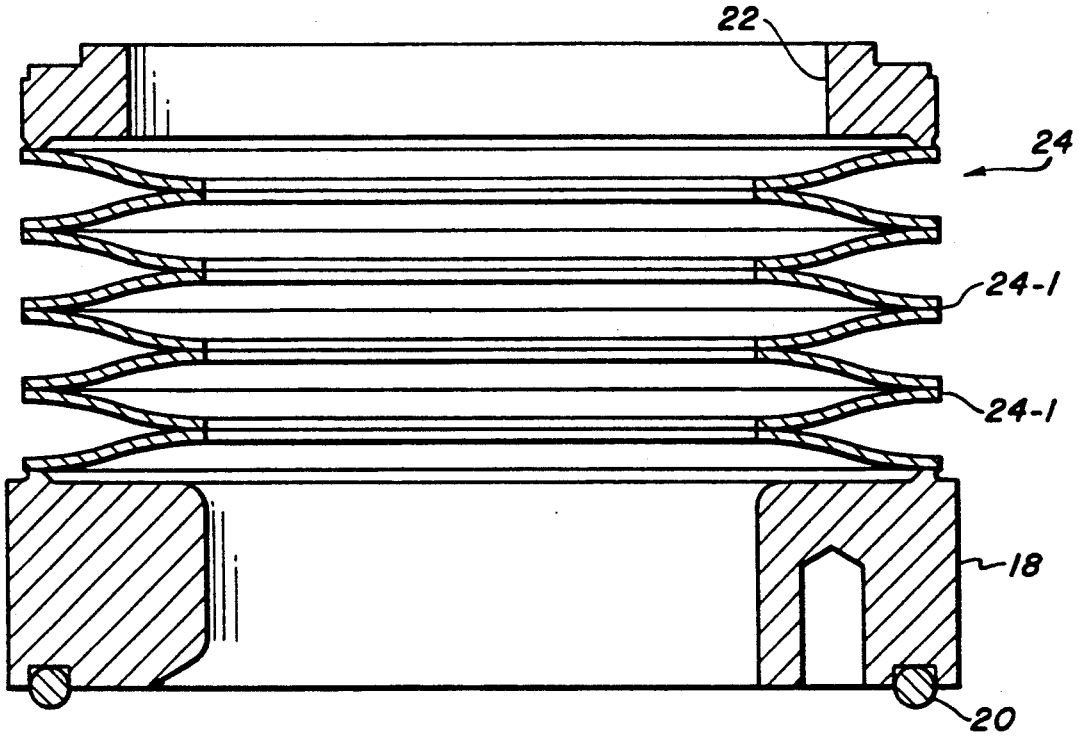
FIG. 6 is a sectional view of the bellows seal showing its attachment structure.

Referring now to FIG. 6, it will be noted that the bellows 24 is made up of a plurality of metal diaphragm elements 24-1 welded together to form a fluid tight unit.

Bellows 124 is similarly constructed.

What is claimed is:

1. A fluid machine comprising:

housing means having a generally cylindrical piston bore formed therein with a radially extending top portion;

piston means having an annular cylindrical portion with a transverse top section located in said cylindrical piston bore and operatively connected to driving means for reciprocating said piston means, within said cylindrical piston bore and forming a working space for gas with said radially extending top portion of said housing means during reciprocation of said piston means, said annular cylindrical portion including a first section located adjacent said driving means;

said annular cylindrical portion of said piston means having a clearance with said piston bore such that contact does not take place therebetween during normal operation, a bellows assembly axially coextensive with said piston means having a first end secured and sealed to said housing means and a second end secured and sealed to said first section of said annular cylindrical portion whereby said bellows assembly expands and contracts due to reciprocating movement of said piston means; and a buffer means defining a space between said bellows assembly and the clearance between said annular cylindrical portion of said piston means and said piston bore and coaxial with said bellows assembly wherein pressure pulsations in the working space are essentially eliminated.

2. A fluid machine as set forth in claim 1 wherein said cylindrical piston bore of said housing means has an aperature therethrough, and said annular cylindrical portion of said piston means has a venting means circumscribed thereabout such that said venting means is reciprocally located adjacent said aperature whereby thermal loss of gas from said working space leaking along said clearance seal and through said aperature is reduced.

3. A fluid machine as set forth in claim 2 wherein fluid machine is a Stirling Cycle Cryocooler.

* * * * *